United States Patent [19]

Turner et al.

[11] 3,961,847

[45] June 8, 1976

[54] ARCUATE SCREEN FOR AN ELECTROPHOTOGRAPHIC PRINTING MACHINE

[75] Inventors: Timothy D. Turner; Dennis J. Smith, both of Webster, N.Y.

[73] Assignee: Xerox Corporation, Stamford, Conn.

[22] Filed: Mar. 6, 1975

[21] Appl. No.: 556,027

[52] U.S. Cl. ..... 355/4; 96/116; 355/8; 355/67

[51] Int. Cl.[2] ..... G03G 15/22

[58] Field of Search ..... 355/3 R, 4, 8, 11, 52, 355/67–71; 354/354, 1, 20; 96/116–118

[56] References Cited

UNITED STATES PATENTS

| | | | |
|---|---|---|---|
| 3,120,790 | 2/1964 | Carlson et al. | 355/3 R |
| 3,497,296 | 2/1970 | Faw | 355/71 X |
| 3,540,806 | 11/1970 | Starkweather | 355/3 R |
| 3,797,934 | 3/1974 | Miller et al. | 354/354 X |

*Primary Examiner*—L. T. Hix
*Assistant Examiner*—Kenneth C. Hutchison
*Attorney, Agent, or Firm*—Henry Fleischer; James J. Ralabate; Clarence A. Green

[57] ABSTRACT

An electrophotographic printing machine in which an arcuate screen member has a plane of curvature substantially normal to the plane of curvature of an arcuate photoconductive member employed therein.

18 Claims, 6 Drawing Figures

ARCUATE SCREEN FOR AN ELECTROPHOTOGRAPHIC PRINTING MACHINE

BACKGROUND OF THE INVENTION

This invention relates generally to an electrophotographic printing machine, and more particularly concerns an optical system having an arcuate screen for producing half-tone images of an original document.

A typical electrophotographic printing machine exposes a charged photoconductive member to a light image of an original document. The irradiated areas of the photoconductive member are discharged recording thereon an electrostatic latent image corresponding to the original document. A development system moves a developer mix of carrier granules and toner particles into contact with the latent image recorded on the photoconductive member. Toner particles are attracted electrostatically from the carrier granules to the latent image. In this manner, a powder image is formed on the photoconductive member. Thereafter, the powder image is transferred to a sheet of support material. After transfer, the sheet of support material passes through a fusing device which permanently affixes the toner powder image thereto.

A multi-color electrophotographic printing machine also employs this concept. However, in multi-color electrophotographic printing, each cycle is repeated a plurality of times, one for each discrete color being reproduced. In multi-color printing, the light image is filtered to record an electrostatic latent image on the photoconductive member corresponding to a single color. This single color electrostatic latent image is developed with toner particles of a color complimentary to the color of the filtered light image employed to form the latent image. Thereafter, the toner powder image is transferred to a sheet of support material. This multi-layered toner powder image is then permanently affixed to the sheet of support material forming a permanent color copy of the original document.

In most electrophotographic printing machines, tone gradations are difficult to form. To obviate this problem, screening methods are employed. Generally, a screening technique produces effect of tone gradation by variations in dot or line size. In the highlight zones, the dots or lines are small. These dots or lines increase in size through the intermediate shades until they merge together in the shadow region. At the highlight end of the tone scale, there will be complete whiteness while at the shadow end nearly solid black. The foregoing is described in U.S. Pat. No. 2,598.732, issued to Walkup in 1952. Other patents exemplifying various screening techniques are; U.S. Pat. No. 3,535,036, issued to Starkweather in 1970, U.S. Pat. No. 3,121,010, issued to Johnson et al. in 1964, U.S. Pat. No. 3,493,381, issued to Frosch in 1973, and U.S. Pat. No. 3,809.555, issued to Marley in 1974. Recently filed applications describing different screening techniques are copending application Ser. No. 511,976, filed in 1974, and copending application Ser. No. 507,169, filed in 1974.

It is well known that the illumination of an image point is in proportion to the $COS^4$ of the solid angle between the illumination point and the image point. Thus, it can be seen that the illumination on a photoconductive surface will fall off quite rapidly as the solid angle increases. Various techniques have been devised to compensate for this effect. Typically, a sheet of opaque material having a butterfly slit formed therein is employed. The area of the slit is inversely proportional to the illumination profile. The butterfly slit is flat and the distance between the photoconductive surface and the slit varies. Thus, the light image projected through the slit, and, in turn the screen, travels differing distance to the photoconductive surface. This height variation results in copies having non-uniform density and color balance shifts.

It is the primary object of the present invention to improve the optical system of an electrophotographic printing machine by obtaining uniform copy density and color balance.

SUMMARY OF THE INVENTION

Briefly stated, and in accordance with the present invention, there is provided an electrophotographic printing machine having an arcuate photoconductive member.

Pursuant to the features of the present invention, an arcuate screen member is mounted in the printing machine and closely spaced to the photoconductive member. The plane of curvature of the screen member is substantially normal to the plane of curvature of the photoconductive member.

BRIEF DESCRIPTION OF THE DRAWINGS

Other objects and advantages of the present invention will become apparent upon reading the following detailed description and upon reference to the drawings, in which.

While the present invention will be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

DETAILED DESCRIPTION OF THE INVENTION

Figure 1:
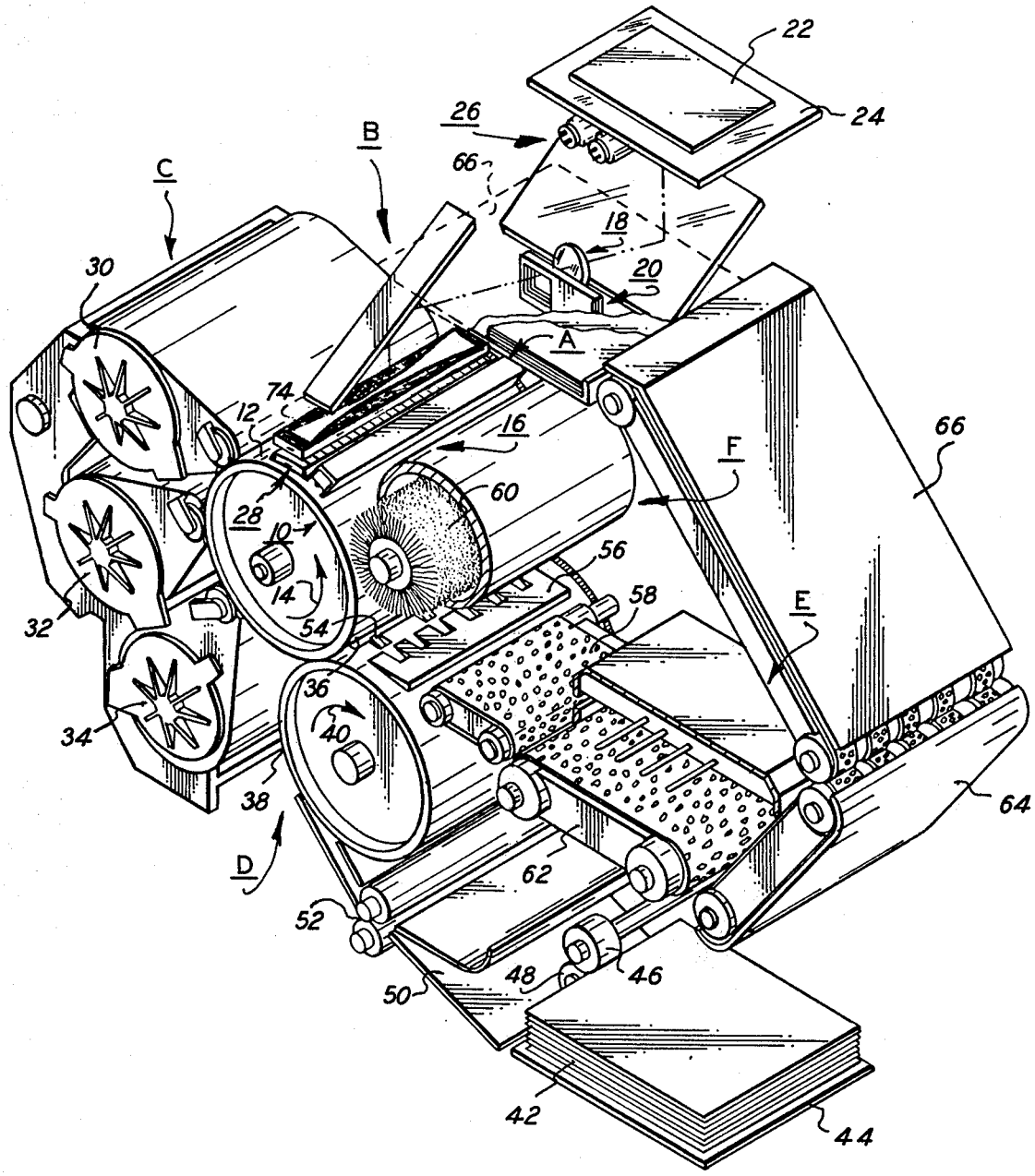
FIG. 1 is a schematic, perspective view of an electrophotographic printing machine incorporating the features of the present invention therein.

For a general understanding of the electrophotographic printing machine, in which the present invention may be incorporated, reference is made to FIG. 1. Throughout the drawings, like reference numerals have been used to designate like elements. FIG. 1 depicts a multi-color electrophotographic printing machine arranged to produce color copies from a colored original document. The original document may be in the form of single sheets, books, or three-dimensional objects.

An electrophotographic printing machine generally includes a photoconductive member having a rotatable drum 10 with a photoconductive surface 12 entrained about and secured thereto. Preferably, photoconductive surface 12 may be made from a selenium alloy such as is described in U.S. Pat. No. 3,655,377 issued to Sechak in 1972. A timing disc (not shown) is mounted at one end of the shaft of drum 10. This timing disc activates the various processing stations sequentially for producing the desired events at the appropriate time.

For purposes of the present disclosure, the various processing stations positioned about the periphery of drum 10 will be briefly described hereinafter.

As drum 10 rotates in the direction of arrow 14, it passes through charging station A. Charging station A has positioned thereat a corona generating device, indicated generally at 16, which charges photoconductive surface 12 to a relatively high substantially uniform level. Corona generating device 16 extends in a generally traverse direction across photoconductive surface 12 producing a spray of ions for the charging thereof. Preferably, corona generating device 16 is of the type described in U.S. Pat. No. 2,778,946 issued to Mayo in 1957.

After photoconductive surface 12 is charged, drum 10 rotates the charged area thereof to exposure station B. At exposure station B, the charged area of photoconductive surface 12 is exposed to a color filtered light image of the original document. A moving lens system, generally designated by the reference numeral 18, and a color filter mechanism, shown generally as 20, are positioned at exposure station B. U.S. Pat. No. 3,062,108 issued to Mayo in 1952 describes a moving lens system suitable for use in electrophotographic printing. Similarly, U.S. Pat. No. 3,775,006 issued to Hartman, et al. in 1973 discloses a color filter mechanism suitable for use in the FIG. 1 electrophotographic printing machine. Original document 22 is disposed upon transparent viewing platen 24. Lamp assembly 26 is positioned beneath transparent viewing platen 24 and, in conjunction with lens system 18, and filter mechanism 20 moves in a timed relationship with drum 10 to scan successive incremental areas of original document 22. In this manner, a flowing light image of original document 22 is transmitted through slit 74 and screen 28 so as to irradiate the charged area of photoconductive surface 12. As shown in FIG. 1, screen 28 is interposed into the optical light path. However, in other embodiments, screen 28 may be positioned prior to or subsequent to the optical light path. All of the foregoing embodiments will be discussed hereinafter in greater detail with reference to FIGS. 2 through 4, inclusive. The structure of screen member 28 will be described with reference to FIGS. 5 and 6. In this manner, a modulated light image irradiates the charged area of photoconductive surface 12. During exposure, filter mechanism 20 interposes selected color filters into the optical light path. Successive color filters operate on the light rays passing through lens 18 to create a modulated single color light image which records a modulated single color electrostatic latent image on photoconductive surface 12. The foregoing single color latent image corresponds to a preselected spectral region of the electromagnetic wave spectrum.

After the modulated latent image is recorded on photoconductive surface 12, drum 10 rotates to development station C. Three developer units, generally indicated by the reference numerals 30, 32 and 34 are positioned at development station C. A suitable development station employing a plurality of developer units (in this case three) is described in U.S. Pat. No. 3,854,449 issued to Davidson in 1974, the relevant portion of that disclosure being hereby incorporated into the present application. Each of the developer units are magnetic brush developer units. A typical magnetic brush developer unit employs a magnetizable developer mix having carrier granules and toner particles. The magnetic brush forms a directional flux field to continually create a brush of developer mix. The brush is brought into contact with the modulated latent image recorded on photoconductive surface 12. The toner particles adhering electrostatically to the carrier granules of the developer mix are attracted by the greater electrostatic force to the latent image and render it visible. Developer units 30, 32 and 34, respectively, contain discrete toner particles. Each of the toner particles contained in the respective developer unit corresponds to the compliment of the color of the light image transmitted through filter 20. Hence, a modulated electrostatic latent image formed from a green filtered light image is rendered visible by depositing green absorbing magenta toner particles thereon. Similarly, modulated electrostatic latent images formed from blue and red light images are developed with yellow and cyan toner particles, respectively.

After the modulated electrostatic latent images recorded on photoconductive surface 12 is developed, drum 10 rotates to transfer station D. At transfer station D, the toner powder image adhering electrostatically to photoconductive surface 12 is transferred to a sheet of support material 36. A biased transfer roll, shown generally at 38, recirculates sheet 36 and is electrically biased to a potential of sufficient magnitude and polarity to electrostatically attract toner particles from photoconductive surface 12 thereto. A suitable electrically biased transfer roll is described in U.S. Pat. No. 3,612,677 issued to Langdon, et al. in 1971, the relevant portions of that disclosure being hereby incorporated into the present application. Transfer roll 38 is preferably of the same diameter as drum 10 and rotates at substantially the same angular velocity therewith. Thus, as transfer roll 38 rotates in synchronism with photoconductive surface 12, successive toner powder images may be transferred to sheet 36.

Prior to proceeding with a discussion of the remaining processing stations positioned about the periphery of drum 10, the sheet feed path will be briefly described. With continued reference to FIG. 1, sheet 36 is advanced from a stack 42 thereof disposed upon tray 44. Feed roll 46, in operative communication with retard roll 48, separates and advances the uppermost sheet from the stack 42. The advancing sheet moves into chute 50 and is directed into the nip of register rolls 52 thereby. Register rolls 52 align and forward the advancing sheet, in synchronism with the movement of transfer roll 38, to gripper fingers 54 mounted therein. Gripper fingers 54 secure releasably support material 36 to transfer roll 38 for movement in a recirculating path therewith. Successive toner powder images are transferred to support material 36 in superimposed registration with one another forming a multi-layered toner powder image thereon. After the requisite number of toner powder images (in this case three) have been transferred to support material 36, gripper fingers 54 space support material 36 from transfer roll 38. Stripper bar 56 is then interposed therebetween so as to separate support material 36 from transfer roll 38. Thereafter, endless belt conveyor 58 moves support material 36 to fixing station E.

After transferring the requisite number of toner powder images to support material 36, some residual toner particles remain adhering to photoconductive surface 12. Cleaning station F, the final processing station in the direction of rotation of drum 10, as indicated by arrow 14, removes the residual toner particles adhering thereto. A pre-clean corona generating device (not shown) neutralizes the charge on photoconductive surface 12 and the residual toner particles. This enables fibrous brush 16 in contact with photoconductive surface 12, to remove the residual toner particles therefrom. A suitable brush cleaning device is described in U.S. Pat. No. 3,590,412 issued to Gerbasi in 1971.

Returning now to fixing station E, the sheet of support material, which has been advanced to fixing station E, now has the multi-layered toner powder image adhering to support material 36 permanently affixed thereto. The foregoing is achieved by a fuser, indicated generally by the reference numeral 62. Fuser 62 produces sufficient heat to permanently affix the multi-layered toner powder image to sheet 36. One type of fuser is described in U.S. Pat. No. 3,826,892 issued to Draugelis, et al. in 1974, the relevant portions thereof being hereby incorporated into the present application. After the fusing process, sheet 36 is advanced by endless belt conveyors 64 and 66 to catch tray 68 for subsequent removal from the printing machine by the operator.

It is believed that the foregoing description is sufficient for purposes of the present invention to describe the features of an electrophotographic printing machine having the apparatus of the present invention incorporated therein.

Figure 2:
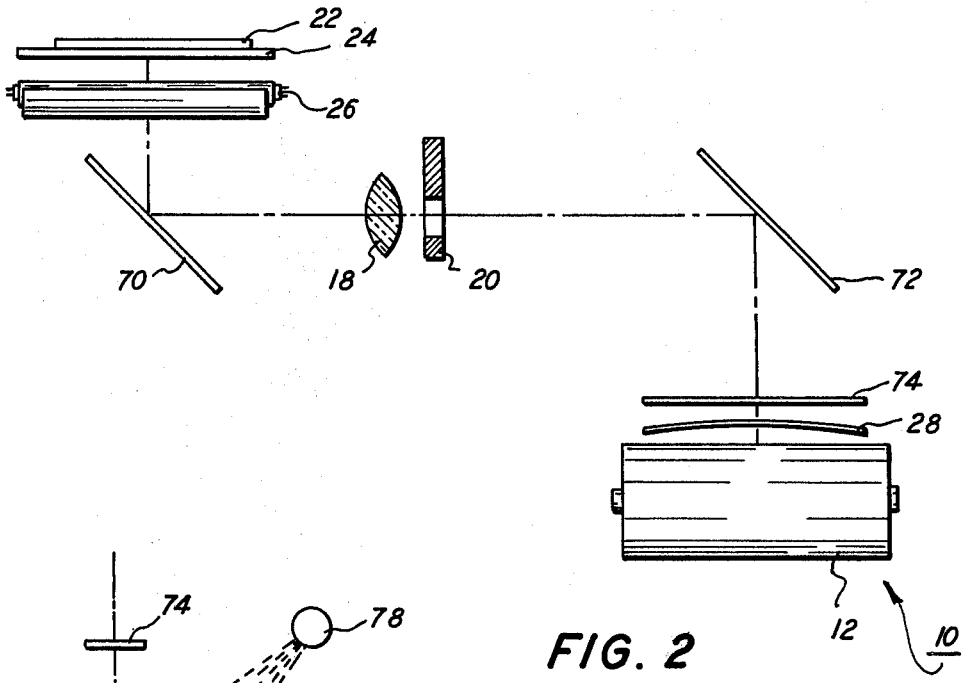
FIG. 2 is an elevational view of one embodiment of the optical system employed in the FIG. 1 printing machine.

Referring now to FIG. 2, one embodiment of exposure station B will be described in greater detail. As shown in FIG. 2, lamps 26 move across platen 24 illuminating original document 22 disposed thereon facedown. Light rays reflected from original document 22 are, in turn, reflected by mirror 70 through lens 18 at filter 20. The single color light image is then reflected by mirror 70 through butterfly slit 78 and screen 28 onto charged photoconductive surface 12 recording a single color electrostatic latent image thereon. Screen member 28 is an arcuate member made preferably, from a flexible transparent sheet having a plurality of spaced opaque dots or lines thereon. The structural configuration of screen member 28 will be described hereinafter with reference to FIGS. 5 and 6. Preferably, slit 74 is made from a sheet of opaque material having a butterfly slit therein. The area of the slit varies inversely at the $COS^4$ of the solid angle between the illumination point and image point. This compensates for the non-linearities in the illumination profile. However, slit 74 is flat, whereas drum 10 is curved. This introduces density variations and color balance shifts in the copy. To correct for the latter variations screen member 28 is arcuate. The plane of curvature of screen member 28 is substantially normal to plane of curvature of drum 10. Screen member 28 may be bowed outwardly away from photoconductive surface 12, (as shown in FIG. 2), or inwardly toward photoconductive surface 12. The curvature of screen member 28 may be hyperbolic or parabolic, i.e. any suitable conical curve. It has been found that copy density changes 10 units/inch of height change. Thus, for a 0.8 inch width slit, the total height difference across slit 74 is 0.020 inch. This results in a copy density variation of 0.20 units. Suitably adjusting the curvature of screen member 28 compensates for this deviation. Screen member 28 is positioned exactly in the printing machine by a suitable frame secured thereto such as by a pair of side rails. This insures the proper alignment between screen member 28 and photoconductive surface 12. In this manner, the single color light image is modulated by screen member 28 recording a modulated single color electrostatic latent image on photoconductive surface 12 which is developed subsequently thereto as hereinbefore described.

Figure 3:
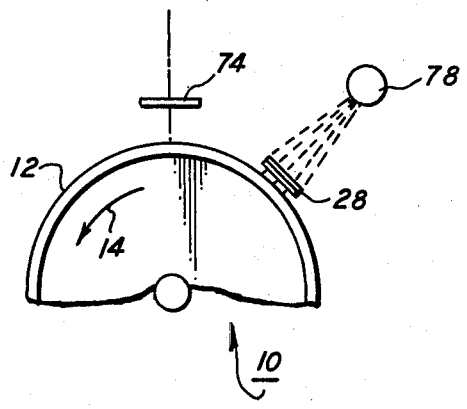
FIG. 3 is a fragmentary elevational view of another embodiment of the optical system employed in the FIG. 1 printing machine.

Referring now to FIG. 3, there is shown another embodiment of exposure station B. Once again, lamps 26 irradiate original document 22 disposed upon transparent platen 24. The light rays reflected from original document 22 are, in turn, reflected by mirror 70 through lens 18. The light image formed by lens 18 thereupon pass through filter 20 forming a single color light image which is reflected by mirror 72 onto photoconductive surface 12. Drum 10 rotates in the direction of arrow 14 and the latent image is recorded in superimposed registration with the portion of photoconductive surface 12 that has previously been exposed to light rays passing through screen member 28. As shown in FIG. 3, light source or lamp 78 transmits light rays through screen member 28 prior to the formation of the latent image thereon. Thus, light rays from light source are modulated by screen member 28 to irradiate the charged portion of photoconductive surface 12 forming a modulated pattern thereon. Thereafter, as drum 10 continues to rotate in the direction of arrow 14, this modulated pattern is again irradiated by the flowing light image of the original document. The flowing light image is superimposed over the modulated pattern so as to record a modulated single color light image on photoconductive surface 12.

Figure 4:
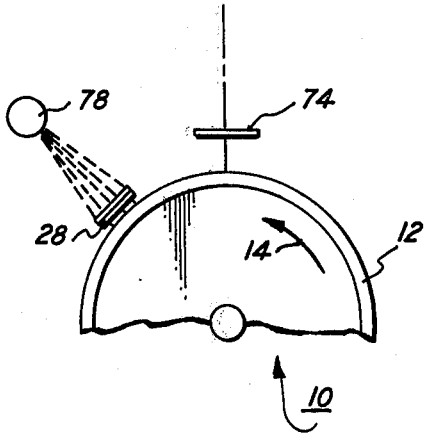
FIG. 4 is a fragmentary elevational view of still another embodiment of the optical system employed in the FIG. 1 printing machine.

Referring now to FIG. 4, there is shown still another embodiment of exposure station B. As heretofore described, lamps 26 illuminate original document 22 disposed upon transparent platen 24. The light rays reflected from original document 22 onto mirror 70 are reflected through lens 18 forming a flowing light image. The flowing light image is filtered by a corresponding color filter or filter mechanism 20 and reflected by mirror 72 onto charged photoconductive surface 12. As drum 10 continues to rotate in the direction of arrow 14, the latent image recorded thereon passes under screen member 28. Light source 78 directs light rays through screen member 28 onto the latent image recorded on photoconductive surface 12. This superimposes a modulated pattern onto the latent image so as to record a modulated electrostatic latent image on photoconductive surface 12 which is subsequently rendered visible at developing station C.

Figure 5:
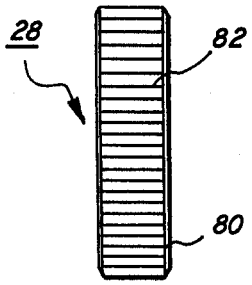
FIG. 5 is an elevational view of a line screen.
Figure 6:
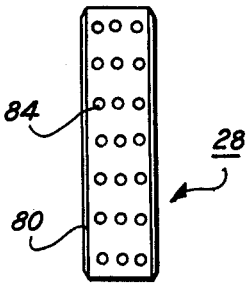
FIG. 6 is an elevational view of a dot screen.

Turning now to FIGS. 5 and 6, screen member 28 includes a flexible substantially transparent sheet 80 made from a suitable plastic such as Mylar. A plurality of spaced opaque lines 82 (FIG. 5) are disposed on sheet 80. In the alternative, a plurality of spaced opaque dots 84 (FIG. 6) may be disposed on sheet 80. Screen member 28 includes a plurality of lines or dots printed on a substantially transparent sheet by a suitable chemical etching or photographic technique. The screen itself may be made from any number of opaque metallic materials suitable for chemical etching which are sufficiently thin to be flexible, such as copper or aluminum. The transparent portion preferably is made from a suitable flexible plastic such as Mylar. Screen 28, as shown in FIG. 5, has a plurality of spaced opaque lines 82 thereon. However, a variety of patterns may be employed in lieu of lines. As shown in FIG. 6, screen 28 may have a plurality of spaced opaque dots 84 thereon. Additional patterns may be rows of small squares entirely surrounded by black or opaque areas, transparent areas continually covered with circular black or opaque dots, or a black opaque background covered with a random distribution of transparent dots of various sizes. Any one of several screen patterns may be employed. A finer screen size generally results in a more natural or higher quality copy. Hence, while a coarse screen having 50 to 60 dots or lines to the linear inch will be useful for some purposes, fine screens such as those having anywhere from 100 to 400 or more dots or lines per linear inch will form a finished copy having a more nearly continuous toner appearance. With finer screens, the screen pattern may be bearly perceptible on the finished copy and the copy will have the appearance of a continuous toner photographic. The contrasting appearance obtained without the use of a screen is eliminated or greatly reduced and large black areas appear to have substantially uniform density throughout. Preferably, screen 28 has 120 lines or dots to the linear inch.

In recapitulation, it is evident that the electrophotographic printing machine incorporates an arcuate screen having the plane of curvature substantially normal to the plane of curvature of the photoconductive drum employed therein. The screen member may be positioned in the optical path. However, other embodiments shown depict the screen member prior to or subsequent to the formation of the latent image. In the latter two embodiments, a separate light source is required rather than the light source utilized to illuminate the original document. In this way, a modulated electrostatic latent image is recorded on the photoconductive surface. The foregoing is subsequently developed to produce a copy corresponding in quality and characteristics to that of the original document being reproduced.

It is, therefore, apparent that there has been provided in accordance with the present invention, an apparatus for producing copies that fully satisfy the objects, aims and advantages hereinbefore set forth. While the present invention has been described in conjunction with various embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An electrophotographic printing machine of the type having an arcuate photoconductive member, including:

an arcuate screen member closely spaced to the photoconductive member with the plane of curvature of said screen member being substantially normal to the plane of curvature of the photoconductive member.

2. A printing machine as recited in claim 1 further including:

means for charging the photoconductive member to a substantially uniform level; and means for projecting a light image of an original document being reproduced in the printing machine through said screen member irradiating the charged photoconductive member to record a modulated electrostatic latent image on the photoconductive member.

3. A printing machine as recited in claim 2, further including means for filtering the light image projected through said screen member onto the charged photoconductive member recording a modulated single color electrostatic latent image thereon.

4. A printing machine as recited in claim 3, further including:

means for developing the single color electrostatic latent image recorded on the photoconductive member with toner particles complementary in color to the color of the filtered light image transmitted through said screen member;

means for transferring the toner particles from the photoconductive member to a sheet of support material; and means for permanently affixing the toner particles to the sheet of support material.

5. A printing machine as recited in claim 4, wherein said screen member includes a flexible, transparent sheet member.

6. A printing machine as recited in claim 5, wherein said sheet member includes a plurality of spaced opaque lines located thereon.

7. A printing machine as recited in claim 5, wherein said sheet member includes a plurality of spaced opaque dots located thereon.

8. A printing machine as recited in claim 1 further including:

means for charging the photoconductive member to a substantially uniform level;

means for projecting a light image of an original document being reproduced in the printing machine onto the charged photoconductive member selectively discharging the photoconductive member in the irradiated areas recording an electrostatic latent image on the photoconductive member corresponding substantially to the original document; and a light source mounted on the printing machine and transmitting light rays through said screen member onto the photoconductive member modulating the latent image recorded thereon.

9. A printing machine as recited in claim 8, further including a means for filtering the light image projected onto the charged photoconductive member recording a single color electrostatic latent image thereon.

10. A printing machine as recited in claim 9, further including:

means for developing the single color electrostatic latent image recorded on the photoconductive member with toner particles complementary in color to the color of the filtered light image transmitted through said screen member;

means for transferring the toner particles from the photoconductive member to a sheet of support material; and means for permanently affixing the toner particles to a sheet of support material.

11. A printing machine as recited in claim 10, wherein said light source is positioned such that the light rays transmitted through said screen member irradiate the charged photoconductive member prior to recording the electrostatic latent image on the photoconductive member with the latent image recorded subsequently thereon being superimposed over the region discharged by the light rays transmitted through said screen member.

12. A printing machine as recited in claim 11, wherein said screen member includes a flexible, transparent sheet member.

13. A printing machine as recited in claim 12, wherein said sheet member includes a plurality of spaced opaque lines thereon.

14. A printing machine as recited in claim 12, wherein said sheet member includes a plurality of spaced opaque dots thereon.

15. A printing machine as recited in claim 10, wherein said light source is positioned such that the light rays transmitted through said screen member irradiate the photoconductive member subsequent to recording the electrostatic latent image thereon with the light rays passing through said screen member being superimposed over the latent image recorded previously on the photoconductive member.

16. A printing machine as recited in claim 15, wherein said screen member includes a flexible, transparent sheet member.

17. A printing machine as recited in claim 16, wherein said sheet member includes a plurality of spaced opaque lines located thereon.

18. A printing machine as recited in claim 16, wherein said sheet member includes a plurality of spaced opaque dots located thereon.

* * * * *